US006543658B2

(12) United States Patent
Trevino

(10) Patent No.: US 6,543,658 B2
(45) **Date of Patent: *Apr. 8, 2003**

(54) ALL WEATHER PROTECTIVE COVER FOR LUGGAGE ITEMS

(76) Inventor: Jose Trevino, 943 N. Expressway, 15-174, Brownsville, TX (US) 78520

( * ) Notice: Subject to any disclaimer, the term of this patent is extended or adjusted under 35 U.S.C. 154(b) by 0 days.

This patent is subject to a terminal disclaimer.

(21) Appl. No.: 09/681,982

(22) Filed: Jul. 3, 2001

(65) Prior Publication Data

US 2001/0038023 A1 Nov. 8, 2001

Related U.S. Application Data

(63) Continuation of application No. 09/545,340, filed on Apr. 7, 2000.

(51) Int. Cl.[7] ..... A45F 4/02

(52) U.S. Cl. ..... 224/153; 224/154; 383/74; 383/75

(58) Field of Search ..... 224/153, 154; 383/72, 74, 75

(56) References Cited

U.S. PATENT DOCUMENTS 4,267,868 A * 5/1981 Lowe ..... 150/11
5,090,559 A * 2/1992 Gendreau ..... 206/278
5,123,117 A * 6/1992 Prendergast ..... 2/108
5,154,332 A * 10/1992 Williams et al. ..... 224/153
5,165,111 A * 11/1992 Lieberman ..... 2/94
5,238,307 A * 8/1993 Mooney et al. ..... 383/74
5,439,153 A * 8/1995 Murdoch et al. ..... 224/151
5,743,448 A * 4/1998 Tsai ..... 224/153
6,224,259 B1 * 5/2001 Guerra ..... 383/24

* cited by examiner

*Primary Examiner*—Stephen K. Cronin
(74) *Attorney, Agent, or Firm*—Howrey, Simon, Arnold & White LLP

(57) ABSTRACT

A protective cover adaptable to serve as a luggage accessory or be incorporated in a piece of luggage and designed to protect such luggage items, particularly net-type, weather sensitive, and degradable baggage, together with contents of the baggage from weather exposure. When the weather becomes unfavorable or when the situation to protect a luggage item arises, the protective cover is extended from the item and placed over the same. After the cover is positioned over such an item, the user may tighten the perimeter of the cover by pulling on strings that are incorporated within the cover. When the need for the protective cover is no longer needed, the user is able to fold the cover and insert the cover back into the backpack.

13 Claims, 2 Drawing Sheets

ALL WEATHER PROTECTIVE COVER FOR LUGGAGE ITEMS

CROSS REFERENCE TO RELATED APPLICATIONS

This is continuation patent application of U.S. patent application No. 09/545,340 filed Apr. 7, 2000 and entitled "ALL WEATHER PROTECTIVE COVER FOR LUGGAGE ITEMS".

BACKGROUND OF INVENTION

1. Technical Field

The present invention relates to a protective cover, namely a backpack cover, which may either be incorporated in any existing piece of luggage or pack; or may be a carried as a luggage accessory to ensure protection of the luggage item and/or its contents from being exposed to nature's elements.

2. Background of the Invention

The use of luggage items, primarily backpacks, is known in the prior art. Traditionally, backpacks and other transportable baggage have been made primarily of water-resistant material such as polythene to protect the pack and its contents from water, wind, dirt and other natural elements. The water-resistant luggage items have allowed users to not only store and protect various items without being exposed to natural elements, but to also maintain a guarded sense of privacy. Other conventional backpacks have included luggage products that are generally manufactured using perishable materials (such as leather) where the durability of the pack depends on the amount of weather exposure. Although these luggage items tend to be more aesthetically pleasing to a general user, the items tend to have a higher rate of deterioration when exposed to any natural element.

Backpacks and other luggage items have recently evolved to incorporate devices with audio components. An example of such a backpack is shown in U.S. Pat. No. 5,409,152 to Trevino issued on Apr. 25, 1995 depicting a Backpack Assembly with Audio Components. Specifically, the backpack assembly holds audio components within a plurality of pockets formed interiorly of the pack. One of the plurality of pockets is sized to hold a speaker therein and a second of the plurality of pockets is sized to hold a radio therein.

However, due to changing educational policies throughout the United States, many school districts have enacted programs where backpacks must be see-through to ensure increased school security. The result has been to enforce rules that require backpacks to be made with materials that permit clear visibility of the inside contents of the backpack. To enable compliance with the new policies and fulfill this new market, several manufacturers are now producing backpacks that are either made of clear material or of net- or mesh type material.

Specifically, the net-type backpack is made of material having holes uniformly dispersed on the front and sides of the backpack itself. Although this particular material has solved the security requirement mandated by the school districts, an elemental exposure problem has arisen. For example, on a day of rain, all contents (including electronics) contained inside the backpack are subject to rainwater. Likewise, on a day of strong winds, backpack contents are subject to dust and dirt. Therefore, the net-type backpack has introduced elemental exposure and increased deterioration to a luggage item and its contents.

Conventionally constructed luggage and the '152 backpack do not normally pose an exposure problem, but they do not conform to the new security policies and their use has been eliminated in many circumstances. Further, similar to the conventional luggage items, the '152 backpack assembly fails to provide for an incorporated protective cover such as a backpack cover contained within the luggage item itself. Thus, when nature's elements (such as rain, snow, sun, wind or dirt) come into contact with the backpack, the material of the backpack may be damaged. Further, radios, speakers, tape players, CD players and any other type of device installed in the backpack may also be damaged or destroyed by exposure. Also, depending on the type of material used for the luggage, the useful life of the material may be shortened due to weather exposure and deterioration.

In view of the above described deficiencies associated with the use of more recently designed luggage items, and especially backpacks that are constructed from weather permeable materials, the present invention has been developed to alleviate these drawbacks and enhance the utility of these and more conventionally designed luggage pieces. These enhancements and benefits are described in greater detail hereinbelow with respect to several alternative embodiments of the present invention.

SUMMARY OF INVENTION

The present invention in its several disclosed embodiments alleviates the drawbacks described above with respect to conventionally designed luggage and incorporates several additional beneficial features.

A standard luggage item, namely a backpack, is generally constructed with a non-transparent, durable material allowing items to be stored and carried while maintaining privacy. However, a more current luggage item is being manufactured to conform to newly enacted educational policies regarding increased security measures at various school districts. As a result, the evolved luggage item is primarily being offered in two forms: as a clear backpack; or as a backpack made of mesh-or net-type material.

The present invention is a cover designed to protect existing luggage items including backpacks, but finds special utility when incorporated on these newer exposing luggage types. The protective cover is preferably made of plastic or other weatherproof material in order to act as a shield for all luggage items. In particular, the protective cover is preferably incorporated within a luggage item. When the weather becomes unfavorable or when protection for a luggage item is necessitated, the protective cover of the present invention is then pulled from the luggage item and placed thereover. After the cover is properly positioned, the user may tighten the perimeter of the cover by pulling on drawstrings incorporated within the cover. As a result, luggage contents, and the luggage piece itself are protected from exposure to natural elements without compromising security standards when in school where the cover is not needed.

A preferred embodiment of the present invention incorporates the protective cover into the construction of an existing luggage item itself, especially the net-type backpack where exposing backpack contents to natural elements is desirably eliminated. The cover may be attached to either the inside of a compartment or to the bottom, front, top or side portions of the net-type backpack by utilizing various fastening mechanisms such as stitching, gluing or other adaptable means. When time for use arises, the protector is pulled out of the compartment or other storage area and placed over the luggage item. Here, the incorporation of the protective cover inside a compartment of a luggage item thereby relieves a user with an increasingly busy lifestyle from having to carry a separate protective means and protect the luggage item without hindering the user's mobility . An advantage of this invention is to protect the contents of the net-type backpack from weather exposure while also permitting conformance with security standards. As an additional benefit, the longevity and durability of a piece of luggage is increased because of the protection afforded the luggage item itself from weather exposure when under cover.

An alternative embodiment discloses the protective cover as an independent and separate luggage accessory, especially for pre-sold luggage items that are already used by the general public. Here, the luggage protector may be carried apart from the luggage item itself. It is contemplated that when the weather is unfavorable, the user simply fetches the luggage protector and positions the protector around the luggage item.

The luggage protector of the present invention is capable of being incorporated into any existing luggage item, namely a backpack, in order to conform to existing designs of such luggage items. Further, the protective cover does not require special technology for its production and is easy and inexpensive to manufacture.

A further advantage of the present invention is to provide a universal weather-resistant protective cover regardless of the size, material or use (such as recreational or professional) of the luggage item in order to protect the luggage and its contents from being exposed to the elements such as rain, snow, dirt, etc.

BRIEF DESCRIPTION OF DRAWINGS

The invention will now be described in greater detail in the following way of example only and with reference to the attached drawings, in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale where some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
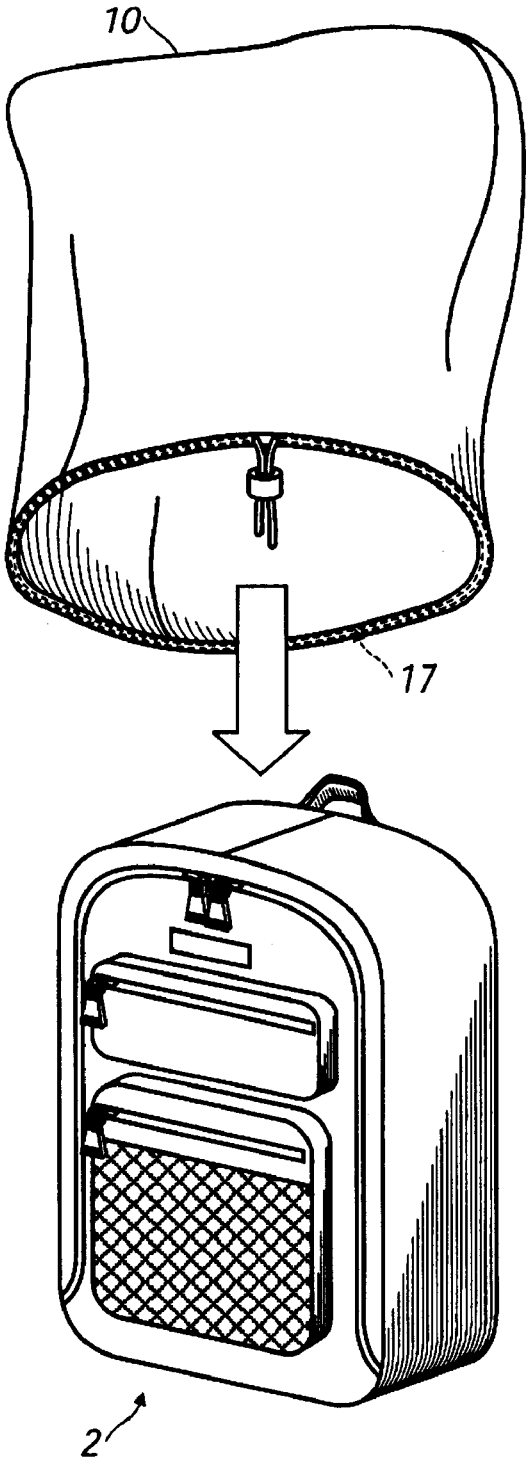
FIG. 1 shows a perspective view of a luggage item, namely a backpack, having a protective cover incorporated integrally therewith.

FIG. 1 illustrates a conventional luggage item, namely a backpack 2, having a bottom, front, two sides and a top/upper portion of the backpack 2. The luggage item also includes a protective cover 10. Preferably, the protective cover 10 is made of plastic or other weatherproof material to ensure durability. The protective cover 10 may be attached within a compartment or upon any internal or external portion of the backpack 2 by using various fastening means such as stitching, gluing, VELCRO or other adaptable means. The protective cover 10 is preferably located at the bottom portion of the backpack 2 leaving more room towards the upper portion for storing and carrying other items.

Figure 3:
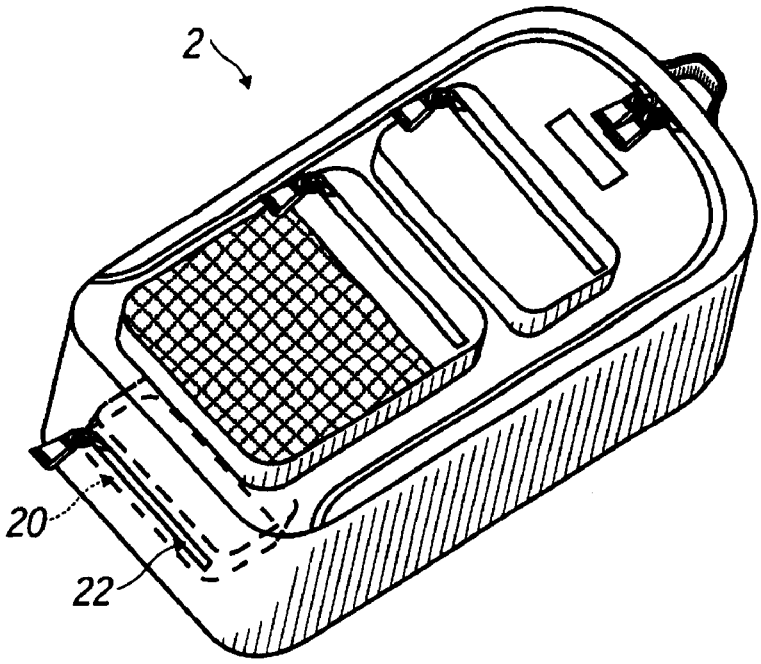
FIG. 3 depicts a perspective view of the luggage item with an internal compartment configured to receive a protective cover and shown in lines which has a closing mechanism, such as a zipper, incorporated therewith.
Figure 4:
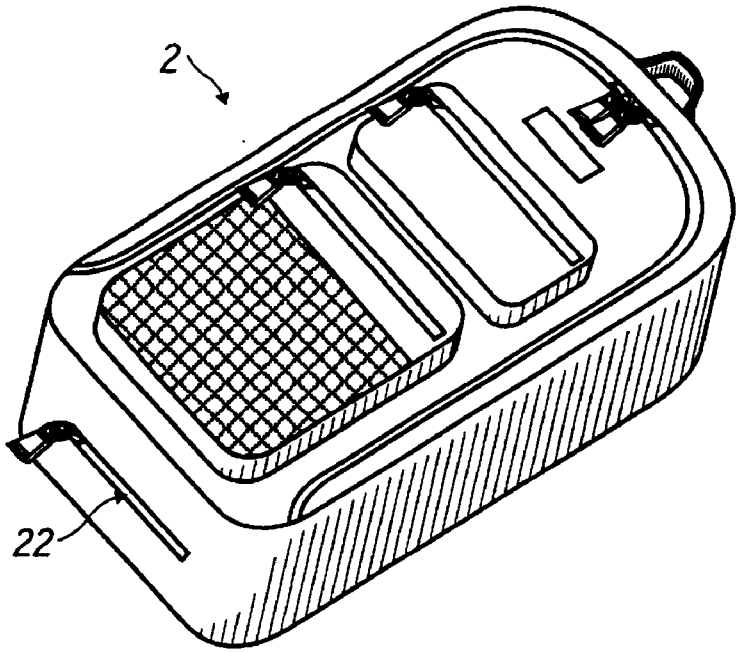
FIG. 4 shows a perspective view of the luggage item showing its only marginally interrupted exterior appearance caused by the invention's integral incorporation.

FIG. 3 depicts a backpack 2 of substantially conventional design, but having a compartment 20 preferably included at the bottom portion of the backpack 2. The compartment 20 includes a closing mechanism 22 as seen in FIGS. 3 and 4. Here, the closing mechanism 22 may include a zipper, a VELCRO fastener, one or more buttons, a latch or any other suitable closure mechanism. In FIG. 3, the protective cover 10 is housed within the compartment 20 for storage purposes. When time for use arises such as during inclement weather, the user opens the closing mechanism 22 and extends the protective cover 10 from the compartment 20. The user then positions the protective cover 10 about the pack 2, namely over the bottom, front, top and two sides of the backpack 2.

Figure 2:
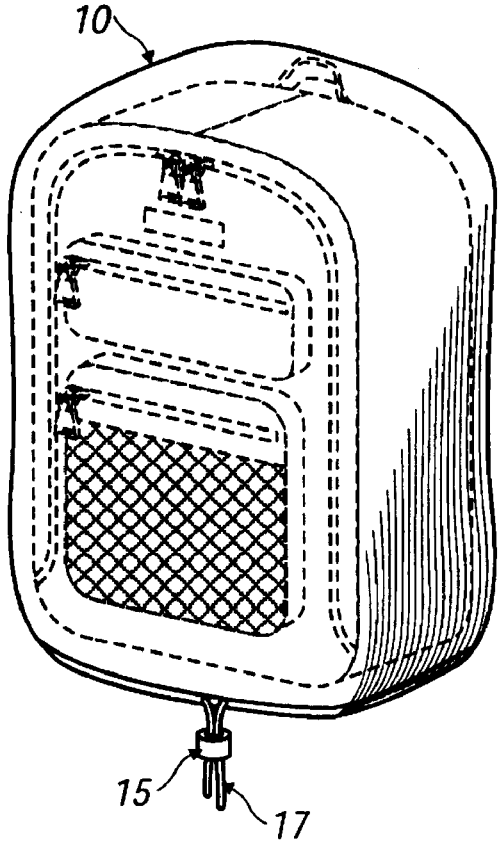
FIG. 2 is a perspective view of the protective cover installed over a luggage piece and having drawstrings held together by a string-holder.

In FIG. 2, the protective cover 10 comprises a string-holder 15 and a drawstring having two ends. The drawstring 17 outlines the perimeter of the protective cover 10, where the perimeter of the protective cover 10 is doubled with the same material made to produce the protective cover 10 and thereby forming a sleeve. Here, the drawstring 17 is imbedded within the doubled material of the perimeter so as not to be visible to the user, except at the bottom of the protective cover 10 where the ends protrude. In this area, the drawstring 17 is exposed at the bottom of the protective cover where one end of the string 17 is projected out of the left side of the protective cover 10 and the other end is extended from the right side of the cover 10. The two ends of the drawstring 17 are then united and held by a string-holder 15. Alternatively, the perimeter of the protective cover 10 may be fashioned to be self-gathering and which therefore naturally expands or contracts about the underlying luggage piece.

Once the protective cover 10 is extended over the backpack 2 covering the bottom, front, sides and top of the backpack 2, the two ends of the drawstring 17 will be pulled downward while the string-holder 17 is held in an upward position causing the protective cover 10 to contract and grip the backpack 2. The protective cover 10 will then be covering the backpack 2, except for the portion that is positioned adjacent to the back of the user. When the protective cover 10 is no longer needed, the string-holder 17 is pulled in a downward position causing the protective cover 10 to enlarge and allowing the user to slip the cover 10 off the covered portions of the backpack 2. The bottom portion of the protective cover 10 continuously remains attached to the backpack 2 through the abovementioned fastening mechanism. The protective cover 10 is then rolled up and inserted into the compartment 20 of the backpack 2. The closing mechanism 22 to the compartment is then closed allowing the protective cover 10 to be stored therein until later deployed.

INDUSTRIAL APPLICABILITY

The present invention finds specific industrial applicability in the luggage and school supplies industries.

What is claimed is:

1. An improved backpack assembly comprising:

a backpack having a protective cover-concealing compartment, and protective cover designed for covering said backpack, thereby protecting the contents of the backpack, said protective cover able to be attached to said cover-concealing compartment of said backpack by a fastening mechanism, said protective cover further being a single unit able to cover said backpack without regard to the fullness of the backpack.

2. The improved backpack assembly as recited in claim 1, where said compartment is positioned on an external portion of said backpack.

3. The improved backpack assembly as recited in claim 1, where said compartment is located on an internal portion of said backpack.

4. The improved backpack assembly as recited in claim 1, wherein said compartment further comprises a closing mechanism.

5. The improved backpack assembly as recited in claim 4, wherein said closing mechanism is a zipper.

6. The improved backpack assembly as recited in claim 1, wherein said protective cover is constructed from waterproof material.

7. The improved backpack assembly as recited in claim 1, wherein said protective cover has a sleeve formed about a perimeter thereof; and a string having two ends, where said string is positioned along said perimeter of said protective cover.

8. The improved backpack assembly as recited in claim 7, wherein said two ends of said string are united and held by a string-holder.

9. The improved backpack assembly as recited in claim 1, wherein said protective cover has a gathered perimeter.

10. The improved backpack assembly as recited in claim 1, wherein said protective cover is attached to said compartment of said backpack by a fastening mechanism and said protective cover is inserted into said compartment for storage prior to being extended from said compartment for use.

11. A protectable backpack comprising:

a backpack body having a baggage receiving compartment and a cover receiving compartment, each of said compartments located within said body;

a deployable cover fastened to said body at a location within said receiving compartment, said cover being configured to be contained within said cover receiving compartment in a stored configuration and deployed to form a protective sheath about said body in a deployed configuration; and an elastic member positioned at a perimeter of said cover, said elastic member adapted to cause cinching of said protectable cover securely about said backpack body in the deployed configuration.

12. The protectable backpack as recited in claim 11, said deployable cover further comprising a sleeve formed at a perimeter of said cover and a drawstring positioned within said sleeve with ends of said drawstring extending from said sleeve, said sleeve and said drawstring arranged to permit cinching of said protectable cover securely about said backpack body in the deployed configuration.

13. The protectable backpack as recited in claim 12, further comprising a securement device adapted to secure two ends of said drawstring together by releasable attachment to said drawstring at two locations exterior to said sleeve.

* * * * *